United States Patent [19]

Quentin

[11] 4,211,579

[45] Jul. 8, 1980

[54] METHOD OF PURIFYING INDUSTRIAL SUGAR SOLUTIONS

[76] Inventor: Gerhard Quentin, Pomona 134, 4040 Neuss, Fed. Rep. of Germany

[21] Appl. No.: 930,548

[22] Filed: Aug. 2, 1978

[30] Foreign Application Priority Data

Aug. 10, 1977 [DE] Fed. Rep. of Germany ..... 2735995

[51] Int. Cl.[2] ..... C13D 3/14

[52] U.S. Cl. ..... 127/46 A; 127/9; 210/30 R; 210/35

[58] Field of Search ..... 127/46 A, 46 B, 9; 210/33

[56] References Cited

U.S. PATENT DOCUMENTS

| | | | |
|---|---|---|---|
| 3,200,067 | 8/1965 | Levendusky | 210/33 X |
| 3,351,488 | 11/1967 | Zievers | 127/46 A X |
| 3,436,344 | 4/1969 | Canning | 127/9 X |
| 3,785,864 | 1/1974 | Lauer | 127/46 A |
| 3,975,205 | 8/1976 | Munir | 127/46 A |
| 4,001,113 | 1/1977 | Karlheinz | 210/33 |

*Primary Examiner*—Sidney Marantz

*Attorney, Agent, or Firm*—Michael J. Striker

[57] ABSTRACT

A method of purifying industrial sugar solutions using ion exchangers, in which the starting solution is always situated underneath the water to be displaced, and the column is eluted from above. The ion exchanger may have resin column components which may further constitute exchange and adsorption stages. The method results in a maximum utilization of the column capacity with a minimum amount of dilution of the purified and of the non-sugar solutions.

8 Claims, 2 Drawing Figures

METHOD OF PURIFYING INDUSTRIAL SUGAR SOLUTIONS

BACKGROUND OF THE INVENTION

The invention relates to a method of purifying industrial sugar solutions by the adsorption of the non-sugar substances at ion exchangers, especially at cation exchangers employing calcium.

Industrial sugar solutions, for instance, molasses, are usually obtained as the final run during the production of sugar from sugar beets and sugar cane. Molasses contain, in the known composition, non-sugar substances, which prevent a crystallizaton of the sugar out of the molasses and which must be separated when it is desired to extract the sugar from the molasses in its crystalline form.

It is already known to separate the non-sugar substances by ion exchange with the aid of weakly cross-linked cation exchangers in the alkaline form, (German patent publication DT-OS 22 32 093).

There are also known methods by which industrial sugar solutions are separated into sugar substances and non-sugar substances by means of fluid-distribution chromatography at cation exchangers using calcium (German patent publication DT-AS 23 62 211, DT-AS 25 18 284).

A considerable disadvantage of the known methods resides in the heavy dilution of the solutions during the passage through the separating columns. At the direction of flow from above to below, which is required for these methods, and at the necessary huge column diameters, irregularities in the flow during the passage through the columns cannot be avoided. The flow conditions are further disadvantageously influenced by the alternate swelling and shrinking of the resins and by the high input concentration of the starting solutions to be purified. The consequences of this are a strong mixing of the solutions with the fore-running and the aft-running water and a correspondingly minute concentration of the sugar fraction and of the non-sugar fraction.

The sugar fraction and of the non-sugar fraction requires a considerable expenditure for the concentration necessary during the further treatment, both with respect to the costs of installations as well as the continuous energy expenses. The latter constitute a substantial part of the operating costs of these methods.

At low concentrations, the adsorption capacity of the resins is furthermore utilized only to a very limited extent. This makes it necessary to utilize huge resin amounts, with correspondingly high installation costs; a further drawback is the difficulties generally encountered when operating large columns.

SUMMARY OF THE INVENTION

A task of the invention is the purification of industrial sugar solutions by adsorption of the non-sugar substances at ion exchangers while avoiding the heavy dilution of the solution which is encountered in the known method, and the disadvantageous consequences connected therewith.

This task is accomplished in that, during the operation of the resinous column, the solution to be purified is always situated underneath the water to be displaced or the displacing water. To this end, the starting solution, for example molasses, is introduced from below into the column filled with a weakly cross-linked, strongly acidic exchanger using calcium. After the displacement of the water present in the column, the purified sugar solution is withdrawn at the top of the column. The column is then eluted from above with water and, after the displacement of the starting solution present in the column, the non-sugar solution is withdrawn at the bottom of the column.

Inasmuch as the solution to be purified, which has a high specific weight compared to water, is introduced into the column from below, no substantial mixing takes place with the water to be displaced. The purified sugar solution has a high concentration. Similarly, the non-sugar substances reach a high concentration in the pore fluid of the resin. This results in a fuller utilization of the adsorption capacity and in a high concentration of the non-sugar solution during the elution of the column.

As a result of the filling of the column with the solution to be purified from below and the elution with water from above, there result the shrinking of the resin due to the solution from below to above, and the swelling due to water from above to below. As a result, tensions and irregularities in the density of the exchanger mass are substantially prevented. This ensures a uniform flow through the resin column and renders it possible to work with high starting concentrations.

In order to achieve a good purifying effect at a minimal column volume, it is advantageous to withdraw, after the removal of the purified sugar solution, an intermediate fraction of approximately the same magnitude and to feed the same as a prerun for the following cycle. This fraction emerges from the following cycle as purified solution. It has, for all intents and purposes, passed through a double column length and possesses the desired high degree of purification.

It has been further proven as advantageous to conduct the purification in two stages in separate exchanger vessels arranged one after the other. In the first stage, there occurs predominantly the exchange of the alkali ions contained in the solutions to be purified by calcium ions (exchange stage), and in the second stage the adsorption of the non-sugar substances (adsorption stage). The ratio of the resin amounts of the two stages corresponds approximately to the inverse ratio of the exchange capacity to the adsorption capacity of the resin for the solution to be purified. In this working procedure, it is not necessary to regenerate the entire column, but rather only the exchange stage, with a calcium salt solution.

Inasmuch as the elution of the resin column takes place from above to below, the non-sugar solution passes through the exchange stage prior to its exit from the column. Under these circumstances, the predominant part of the alkali ions accepted by the exchanger is displaced by the calcium ions of the non-sugar solution. Herein, the high concentration of the non-sugar solution has an especially advantageous effect. During the subsequent regeneration, only a minute part of the alkali ions accepted by the exchanger remains to be displaced by calcium salt solution. This results in a correspondingly low consumption of the regenerating agent and only a minute amount of waste water.

For a further improvement of the procedure according to the invention, it is advantageous to operate the columns in connection one after the other, i.e. to always operate with two exchange stages and with two adsorption stages. In this manner, the transfer of the intermediate fraction and the subsequent displacement of the starting solution which still remains in the columns can occur directly from column to column without special intermediate vessels. By appropriate connection of the individual stages, any penetration of alkali ions into the adsorption stage can be substantially avoided. To this end, after the removal of the purified sugar solution and the intermediate fraction, the remaining starting solution present in the column is first displaced from the adsorption stage of the first column into the exchange stage of the second column. Thus, this solution passes through the exchange stage two times, immediately upon the regeneration of this stage when passing through for the second time. Only subsequently will the starting solution be displaced from the first exchange stage into the second exchange stage.

BRIEF DESCRIPTION OF THE DRAWINGS

An exemplary embodiment of the invention is diagrammatically illustrated in the drawings and will be described in more detail in the following.

DESCRIPTION OF A PREFERRED EMBODIMENT

The method according to the invention may be advantageously performed in two resin columns I and II which, in turn, are subdivided in an exchange stage IA, IIA, and an adsorption stage IB, IIB.

The exchanger columns I and II are connected by means of conduits 1 to 24, in which there are interposed valves 25 to 45.

Figure 1:
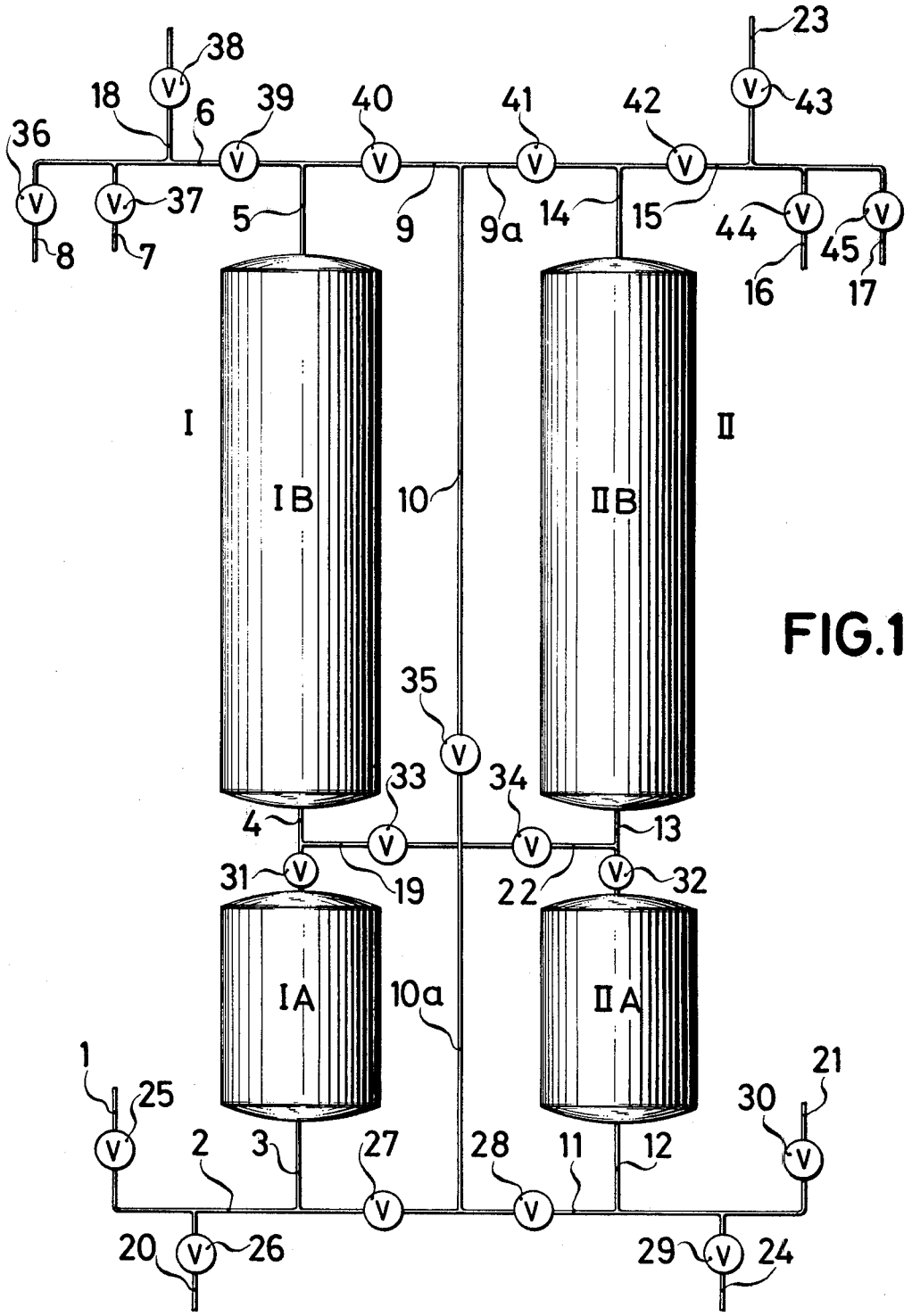
FIG. 1 shows a diagrammatic representation of a two-stage, double-column exchanger.
Figure 2:
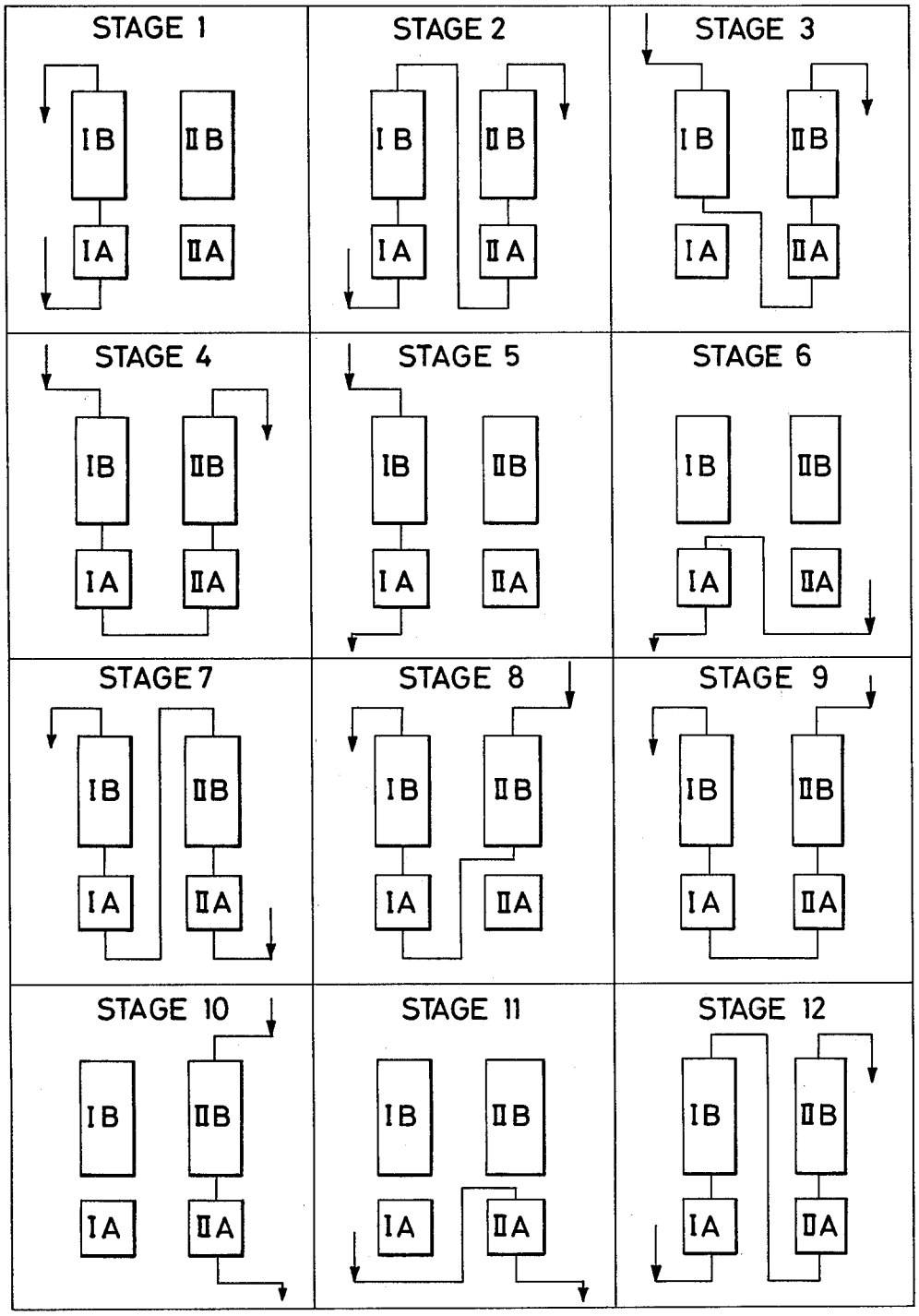
FIG. 2 illustrates the individual operation stages.

The operation of the method according to the invention is as follows:

During the starting of the installation (FIG. 2–stage 1), the starting solution to be purified is conveyed through conduits 1, 2 and 3 to the exchanger stage IA and further through conduit 4 to the adsorption stage IB. Simultaneously, except for the valves 25, 31, 39 and 37, all remaining valves are closed. The water present in the column I is displaced by the starting solution supplied from below and removed through conduit 7. Once the starting solution has reached the valve 37, the latter is closed and the purified solution is withdrawn through the conduit 8 with the valve 36. Subsequently, the valves 36 and 39 are closed, as well as the valves 40, 35, 28, 32, 42 and 44 opened. Now, the intermediate fraction is supplied, through the conduits 9, 10, **10*a*, 11, 12 and 13, to the column II and thus to the exchange stage IIA and to the adsorption stage IIB. As a result of this, a part of the water present in the column II is displaced and removed through the conduit 16. With this, the stage 2 of the operating method is concluded. Now, it is switched to stage 3. To this end, except for the valves 38, 39, 33, 28, 32, 42 and 44, all remaining valves are closed. Simultaneously, water is supplied to the column I through conduit 18. The solution present in the adsorption stage IB is conducted, through the conduits 4, 19, 10*a*, 11 and 12 to the exchange stage IIA and further to the adsorption stage IIB. Simultaneously, the water still present in the column II is withdrawn through conduit 16. Once the sugar solution has reached the valve 44, the latter is closed and the purified solution is withdrawn through conduit 17 and valve 45. In addition thereto, the non-sugar solution present in the adsorption stage IB is displaced downwardly by the water which is supplied from above through conduit 18. Once the non-sugar solution has reached the lower region of the adsorption stage IB, then, for the purpose of switching to stage 4, valve 33 is closed and the valves 31, 27, 28 opened, so that the solution present in the exchange stage IA can be forwarded into the exchange stage IIA. Once the non-sugar solution has reached the lower region of the exchange stage IA, then, for the purpose of switching to stage 5, valve 27 is closed and valve 26 opened. Thereafter, the non-sugar solution is withdrawn through the conduit 20. For the purpose of switching to the regeneration stage 6, only the valves 30, 28, 33 31 and 26 are open and simultaneously a calcium salt solution is supplied through conduits 21, 11, 10*a*, 19 and 4 to the exchange stage IA for regeneration, which is then conducted away through conduit 20**. Before the regeneration, the stage IA is still reversedly flushed and after the regeneration washed out for the removal of the still present salt solution. Upon the termination of the regeneration, the stage IA is filled with water.

Now, the exchanger process commences with stage 7 in mirror-symmetrical version with respect to stage 2. At the corresponding switching of the valves, the starting solution to be purified is supplied through conduit 21 to the exchange stage IIA and further conducted into the adsorption stage IIB. After the desired amount has passed through the adsorption stage the process is then switched to stage 8, which corresponds, in a mirror-symmetrical fashion, to stage 3. Furthermore, the stages 9 to 11 mirror-symmetrically correspond to the stages 4 to 6. Once the operating procedure has reached the stage 11, then it is again switched to stage 2, and the initially described process is again instituted.

The special advantage of the method according to the invention is to be seen in the fact that the concentrations of the purified sugar solution and of the non-sugar solution are considerably higher than in the heretofore known methods, and that the required resin amounts lie considerably below those of the known installations. Inasmuch as the exchange of the alkali ions present in the solutions by calcium ions takes place predominantly in the first stage and the separation into sugar fraction and non-sugar fraction in the second stage, it is not necessary to regenerate the entire column with a calcium salt solution. The regeneration is performed only in the smaller exchange stage. Inasmuch as the elution of the column takes place from above to below, the non-sugar fraction passes through the exchange stage prior to its discharge from the column. The result of this is that a large proportion of the alkali ions accepted by the exchanger is again displaced in the reverse direction by the calcium ions of the non-sugar fraction. Herein, the high concentration of the non-sugar fraction has an especially advantageous effect.

During the subsequent regeneration with calcium salt solution, only a small number of the alkali ions accepted by the exchanger remain to be displaced. Herein, the regeneration also occurs in the reverse direction.

The invention is not limited to the illustrated exemplary embodiment. So, it is conceivable, without any problems, to perform the method according to the invention in a single one-stage column or in two one-stage columns. Also, three exchange stages can be operated with two adsorption stages, wherein one exchange stage is always in the regeneration phase. In this manner, the method of the invention can be performed on a continuous basis. Corresponding conduits and valves are to be provided for this.

I claim:

1. A method of purifying an industrial sugar solution by adsorption of non-sugar substances using an ion exchanger, comprising supplying said solution to said ion exchanger through a lower portion of said ion exchanger, thereby displacing a volume of water contained in said ion exchanger; withdrawing a purified sugar solution through an upper portion of said ion exchanger; eluting said ion exchange through an upper portion of said ion exchanger; displacing remaining industrial sugar solution in said ion exchanger; and withdrawing said non-sugar substances through a lower portion of said ion exchanger.

2. A method as defined in claim 1, wherein said ion exchanger is in the calcium form.

3. A method as defined in claim 1, wherein said displacing step further comprises withdrawing an intermediate solution fraction and using it as a prerun before a subsequent repetition of said method.

4. A method as defined in claim 1, employing more than one resin column in said ion exchanger.

5. A method as defined in claim 4, wherein said resin columns comprise exchange and adsorption stages.

6. A method as defined in claim 5, wherein a ratio of resin amounts in said exchange and adsorption stages corresponds to the inverse ration of exchange capacity to adsorption capacity of a resin used in said column.

7. A method as defined in claim 5, wherein said ion exchanger comprises a first exchange and a first adsorption stage, and a second exchange and a second adsorption stage, and wherein said displacing occurs first through said first adsorption and said second exchange stages, and then through said first exchange and said second exchange stages.

8. A method as defined in claim 7, wherein said first exchange stage is regenerated with a salt solution after said withdrawing of said non-sugar substances.

* * * * *